US010865525B2

(12) United States Patent
Ehrhardt et al.

(10) Patent No.: US 10,865,525 B2
(45) Date of Patent: Dec. 15, 2020

(54) BIOPOLYMER SIZING AGENTS

(71) Applicant: Solenis Technologies, L.P., Schaffhausen (CH)

(72) Inventors: Susan M Ehrhardt, Haddonfield, NJ (US); Daniel F Varnell, Wilmington, DE (US)

(73) Assignee: SOLENIS TECHNOLOGIES, L.P., Wilmington, DE (US)

( * ) Notice: Subject to any disclaimer, the term of this patent is extended or adjusted under 35 U.S.C. 154(b) by 61 days.

(21) Appl. No.: 15/493,773

(22) Filed: Apr. 21, 2017

(65) Prior Publication Data

US 2017/0335520 A1 Nov. 23, 2017

Related U.S. Application Data

(60) Provisional application No. 62/331,000, filed on May 3, 2016.

(51) Int. Cl.

| | |
|---|---|
| ***D21H 21/16*** | (2006.01) |
| ***D21H 17/24*** | (2006.01) |
| ***D21H 17/25*** | (2006.01) |
| ***D21H 17/23*** | (2006.01) |
| ***D21H 17/27*** | (2006.01) |
| ***D21H 17/26*** | (2006.01) |
| ***D21H 17/28*** | (2006.01) |
| ***D21H 19/52*** | (2006.01) |
| ***D21H 19/54*** | (2006.01) |
| ***D21H 19/12*** | (2006.01) |

(52) U.S. Cl.

CPC ..... *D21H 21/16* (2013.01); *D21H 17/23* (2013.01); *D21H 17/24* (2013.01); *D21H 17/25* (2013.01); *D21H 17/26* (2013.01); *D21H 17/27* (2013.01); *D21H 17/28* (2013.01); *D21H 19/12* (2013.01); *D21H 19/52* (2013.01); *D21H 19/54* (2013.01)

(58) Field of Classification Search

CPC ..... D21H 21/16; D21H 17/23

See application file for complete search history.

(56) References Cited

U.S. PATENT DOCUMENTS

| | | | | | |
|---|---|---|---|---|---|
| 12,311,153 | | 6/1917 | Haeffner | | |
| 2,503,297 | A | 4/1950 | Pierce | | |
| 3,395,033 | A | 7/1968 | Remer et al. | | |
| 3,516,910 | A * | 6/1970 | Clark | C02F 5/10 | 159/47.3 |
| 3,644,167 | A | 2/1972 | Mowry | | |
| 3,706,629 | A * | 12/1972 | Moore et al. | D21H 17/42 | 162/163 |
| 4,168,371 | A * | 9/1979 | Brown | B01D 15/34 | 210/656 |
| 4,191,610 | A | 3/1980 | Prior | | |
| 4,313,790 | A * | 2/1982 | Pelton | D21H 17/23 | 162/163 |
| 4,394,213 | A | 7/1983 | Ferm | | |
| 4,772,359 | A * | 9/1988 | Linhart | D21H 17/34 | 162/163 |
| 4,861,376 | A * | 8/1989 | Edwards | C08L 3/08 | 106/209.1 |
| 4,950,361 | A * | 8/1990 | Bender | D21C 9/08 | 162/181.2 |
| 4,952,329 | A * | 8/1990 | Bulatovic | B03D 1/002 | 209/167 |
| 5,049,612 | A * | 9/1991 | Bulatovic | B03D 1/016 | 209/167 |
| 5,110,414 | A | 5/1992 | Forss et al. | | |
| 5,192,361 | A * | 3/1993 | Schilling | C09D 11/14 | 106/123.13 |
| 5,306,327 | A * | 4/1994 | Dingeman | C22B 1/244 | 75/303 |
| 5,460,645 | A | 10/1995 | Pandian et al. | | |
| 5,472,485 | A | 12/1995 | Pandian et al. | | |
| 5,567,277 | A * | 10/1996 | Elliott | D21H 17/23 | 162/163 |
| 5,627,224 | A * | 5/1997 | Lyrmalm | D21H 17/15 | 524/437 |
| 5,811,527 | A | 9/1998 | Ishitoku et al. | | |
| 5,846,663 | A * | 12/1998 | Brungardt | D21H 17/14 | 428/537.5 |
| 6,268,414 | B1 * | 7/2001 | Lin | D21H 21/16 | 162/158 |
| 6,281,350 | B1 * | 8/2001 | Owens | C08G 73/02 | 536/123.1 |
| 2001/0021733 | A1 * | 9/2001 | Peltonen | C08J 3/03 | 524/47 |
| 2002/0084045 | A1 | 7/2002 | Collias et al. | | |
| 2002/0096289 | A1 * | 7/2002 | Frolich | D21H 17/17 | 162/168.1 |
| 2004/0122166 | A1 * | 6/2004 | O'Brien-Bernini | C09J 133/04 | 525/54.31 |
| 2009/0099281 | A1 * | 4/2009 | Sakurai | B60C 1/0008 | 524/76 |

(Continued)

FOREIGN PATENT DOCUMENTS

| | | |
|---|---|---|
| CN | 1782227 A | 6/2006 |
| EP | 0722011 A1 | 7/1996 |

(Continued)

OTHER PUBLICATIONS

European Patent Office International Searching Authority, International Search Report and Written Opinion for International Application No. PCT/US2017/028855 dated Jul. 5, 2017.

(Continued)

*Primary Examiner* — Liam J Heincer

(74) *Attorney, Agent, or Firm* — Lorenz & Kopf, LLP

(57) ABSTRACT

A composition and method for imparting paper and paperboard with resistance to aqueous penetrants using renewable biopolymers, and the resulting paper and paperboard, are disclosed. The renewable biopolymers when combined with water-soluble, hydroxylated polymers or water-soluble salts and applied to the surface of paper or paperboard, results in resistance to aqueous penetrants.

10 Claims, No Drawings

(56) References Cited

U.S. PATENT DOCUMENTS

| | | | | |
|---|---|---|---|---|
| 2009/0139677 | A1* | 6/2009 | Hamers | D21H 17/17 162/175 |
| 2010/0166968 | A1* | 7/2010 | Doherty | D21H 17/23 427/387 |
| 2010/0325947 | A1 | 12/2010 | Ohman et al. | |
| 2011/0029734 | A1 | 2/2011 | Pope et al. | |
| 2011/0146926 | A1* | 6/2011 | Ehrhardt | D21H 17/17 162/164.6 |
| 2011/0297340 | A1 | 12/2011 | Kouisni et al. | |
| 2013/0248111 | A1* | 9/2013 | Brizius | C09J 197/00 156/331.1 |
| 2014/0102651 | A1* | 4/2014 | Johnston | D21H 27/00 162/164.6 |
| 2014/0202647 | A1 | 7/2014 | Hagiopol et al. | |
| 2015/0054736 | A1 | 2/2015 | Brancato et al. | |
| 2015/0232703 | A1* | 8/2015 | Nelson | C09D 197/005 435/99 |
| 2016/0145480 | A1* | 5/2016 | Krigstin | D21H 19/12 427/389.7 |
| 2016/0281299 | A1* | 9/2016 | Jokiranta | C08B 30/12 |

FOREIGN PATENT DOCUMENTS

| | | | |
|---|---|---|---|
| EP | 1794363 | | 1/2012 |
| WO | 0187585 | A1 | 11/2001 |
| WO | 2004088036 | A1 | 10/2004 |

OTHER PUBLICATIONS

Taiwan Patent Office, Office Action issued in Application No. 106114576, dated Oct. 19, 2018.

* cited by examiner

BIOPOLYMER SIZING AGENTS

This application claims the benefit of U.S. Patent Application No. 62/331,000, filed 3 May 2016, the entire contents of which are hereby incorporated by reference.

BACKGROUND OF THE INVENTION

The present invention relates to the use of polymeric compositions based on renewable materials for improving the resistance of paper and paperboard to aqueous penetrants when the composition is applied to the surface of the paper or paperboard. More specifically, the renewable biopolymers are derived from lignin and when combined with water-soluble, hydroxylated polymers and/or water-soluble salts, form a lignin sizing formulation that is then applied to the surface of the paper or paperboard.

A size press is typically used to apply starch to the surface of paper or paperboard to improve smoothness, printability, and strength. It is well known to include a sizing agent in the size press solution to improve resistance to aqueous fluids (e.g., printing inks, adhesives, etc.). Products commonly used for this purpose are based on non-renewable materials, e.g., styrene acrylic polymers, styrene maleic anhydride polymers, etc. It is clearly desirable to provide an alternative based on renewable materials, such as biopolymers. The current invention relates to the use of lignin at a size press to provide paper and paperboard with resistance to aqueous penetrants. Additionally, the method provides for the beneficial effect of including certain salts in the sizing formulation.

Lignin is the amorphous, three-dimensional polymer that 'glues' cellulose fibers together, giving plants their structural integrity. Lignin accounts for roughly one third of the mass of a tree. Lignin is a branched, crosslinked network of C9 phenylpropenyl units resulting from the enzymatic dehydrogenative polymerization of coumaryl alcohol (common in grasses), coniferyl alcohol (common in softwoods), and sinapyl alcohol (common in hardwoods). The relative proportion of these units depend on the lignin source (i.e., plant). For more details on the chemistry of lignin, see Report PNNL-16983 (Holladay J E, White J F, Bozell J J, Johnson D. Top value-added chemicals from biomass. Volume II—results of screening for potential candidates from biorefinery lignin. 2007) and the references cited therein.

The objective of chemical pulping processes is to separate the lignin from the cellulose fibers, leaving the cellulose and hemicelluloses in the form of intact fibers to be used in papermaking. This is accomplished by chemically degrading and extracting the lignin. The two principal chemical pulping methods are the sulfite and kraft processes.

The sulfite process, which was developed in 1867, is typically an acidic process that uses sulfurous acid and bisulfite ion to remove the lignin at elevated temperature and pressure. The sulfites combine with the lignin to form salts of lignosulfonic acid which are soluble in the aqueous cooking liquor. The lignosulfonates in the spent cooking liquor are useful as dispersants, binders, adhesives and cement additives.

The sulfate, or kraft, pulping process (1884) is an alkaline process that uses sodium hydroxide and sodium sulfide to remove the lignin at elevated temperature and pressure. Lignin is broken into smaller segments whose sodium salts are soluble in the alkaline cooking liquor. The waste liquor from this process, known as black liquor, contains these lignin fragments which are referred to as kraft lignin. Kraft lignin is not sulfonated and is only soluble in water at a pH above about 10.

An integral part of the kraft pulping process is the recovery cycle in which the pulping chemicals are regenerated and the lignin burned to produce steam and power for the process. This recovery process can become a bottleneck in the pulping process, limiting pulp production. To address this issue, processes to efficiently separate lignin from black liquor have been developed, reducing the load on the recovery boiler.

Two such processes are the LignoBoost™ process developed by STFI-Packforsk in collaboration with Chalmers University of Technology (EP1794363B1, US2010/0325947A1) and the LignoForce™ process developed by FP Innovations (US 2011/0297340A1). In the LignoBoost™ process, lignin is precipitated out of kraft black liquor using carbon dioxide (lowering pH to about 10) then separated by filtration and washed in a controlled fashion. The resulting lignin product is enriched to >95% lignin. In the LignoForce™ process the black liquor is first oxidized before precipitation. The lignin separated using these processes can be used as a fuel, or as a low cost feedstock for other applications such as carbon fibers or aromatic chemicals (e.g., antioxidants).

There are also other processes known for separating lignin from biomass. Organosolv pulping is a general term for the use of organic solvents, such as ethanol, to remove lignin from wood. Other lignin sources include pyrolysis lignin, steam explosion lignin, dilute acid lignin, and alkaline oxidative lignin (PNNL 16983). Lignins resulting from these processes are not sulfonated, so are only soluble in water at alkaline pH.

Lignin is the second most abundant biopolymer on earth, second only to the cellulose from which it is separated. As such, value-added applications for waste lignin have been investigated since chemical pulping processes were implemented.

The use of waste liquor from the sulfite pulping process (lignosulfonates) to provide water resistance has been known since at least the early 1900's. The introduction to U.S. Pat. No. 1,231,153, mentions that it had "already been proposed to use sulfite waste liquor for sizing paper". This early patent discloses a better result by fermenting the sulfite liquor before use. The fermented sulfite liquor is used with alum to provide sizing in an acid papermaking system, with the optional addition of a rosin soap size. More recent patents that use lignosulfonates in compositions to impart water resistance to paper products include, for example, U.S. Pat. Nos. 4,394,213 and 4,191,610.

There are also patents that disclose the use of non-sulfonated lignins, i.e., kraft lignin or organosolv lignin, to provide sizing when used at an acid pH. For example, U.S. Pat. No. 5,110,414, discloses a method to improve water resistance comprising addition of "high-molar mass" lignin derivatives to the aqueous pulp slurry and adjusting the pH of the mixture to a value in the range of pH 2 to pH 7.

US Patent Application US 2010/0166968 A1, discloses a method for improving the water resistance of a paper product comprising treatment of the paper product with a cationic polymer followed by treatment with lignin in an aqueous solution. However, there is no teaching of a sizing formulation comprising lignin in combination with synthetic water-soluble hydroxylated polymers or water-soluble salts. In teaching cationic starch and polymers, Doherty et al. teach away from the use of substantially anionic or nonionic polysaccharides.

WO 2015/054736 A1, discloses a method of forming a coating on a substrate using a lignin solution to provide improved waterproofing and/or strength. The coating is a solution of lignin, applied at high levels, that is subjected to a thermal annealing step or an acid treatment step after application.

U.S. Pat. No. 5,472,485, discloses examples of zirconium salts including ammonium zirconium carbonate (AZC), ammonium zirconium sulfate, ammonium zirconium lactate, ammonium zirconium glycolate, zirconium oxynitrate, zirconium nitrate, zirconium hydroxychloride, zirconium orthosulfate, zirconium acetate, potassium zirconium carbonate, as salts known to improve surface sizing efficiency, but does not teach the salts in combination with lignin.

There is still a need for compositions that improve the resistance of paper to aqueous penetration using renewable materials, such as, biopolymers. Furthermore, there is a need for such compositions that can be applied to the paper or paperboard under normal alkaline size press conditions.

SUMMARY OF THE INVENTION

Provided are compositions including solutions or dispersions of lignin (referring to material that has been separated from the rest of the biomass) and water-soluble, hydroxylated polymers that can be applied to the surface of paper or paperboard to provide for greater resistance to aqueous penetrants.

It was also discovered that certain water-soluble salts have a beneficial effect on sizing when used with the lignin and provide an even greater level of resistance to aqueous penetrants than when lignin is used alone. In addition, it was also discovered that the current lignin sizing composition provides improved resistance to liquid penetration of the paper or paperboard when applied under alkaline conditions.

Also, provided is a method of improving the resistance of paper or paperboard to aqueous penetrants, wherein the composition, comprising lignin and water-soluble, hydroxylated polymers and optionally, water-soluble salts, such as zirconium and/or aluminum salts, are applied to the surface of the formed paper or paperboard.

The current methods also provide for improving resistance paper or paperboard to aqueous penetrants wherein the surface of the paper or paperboard is treated with an alkaline solution or dispersion of lignin and optionally a water-soluble hydroxylated polymer and/or a water-soluble zirconium or aluminum salt.

The current method also provides for improving resistance of paper or paperboard to aqueous penetrants wherein an alkaline solution or dispersion of lignin is provided and combined with a water-soluble hydroxylated polymer to produce a lignin sizing formulation. The formulations is then applied to the surface of the paper or paperboard.

The current invention also provides for a composition for improving the resistance of paper or paperboard to aqueous penetrants wherein one or more sizing agents selected from salts of styrene maleic anhydride polymers, styrene acrylic acid polymers, ethylene acrylic or methacrylic acid polymers, and anionic styrene acrylic latex; are combined with an alkaline solution or dispersion of lignin.

Also, provided is the paper and paperboard made using the compositions and methods as described above.

DETAILED DESCRIPTION OF THE INVENTION

A size press is typically used to apply starch to the surface of paper or paperboard to improve smoothness, printability, strength and resistance to aqueous penetrants. It has been found that the addition of a lignin, in either solution or dispersed form, to a non-cationic starch solution at an alkaline pH provides sizing (i.e., resistance to aqueous penetrants) when the size press solution is applied to the paper or paperboard and dried in the usual fashion. It has further been found that adding lignin in combination with ammonium zirconium carbonate or sodium aluminate to the non-cationic starch or hydroxylated polymer solution, increases sizing efficiency even more.

In some aspects of the current process, the lignin employed can be any type of lignin, in raw (i.e., black liquor) or purified form, separated from the rest of the biomass as described above. Non-sulfonated lignins, such as those separated from cellulose using the kraft process, organosolv process, pyrolysis, steam explosion, dilute acid, alkaline oxidative, or any other process that generates lignin that is not water-soluble under acidic conditions are especially desirable. It is envisioned that lightly sulfonated lignin can also be used. Additionally, lignins can be further purified using the LignoBoost™ or LignoForce™ processes (see EP1794363B1, US 2011/0297340A1 and US2010/0325947A1).

In some aspects of the above processes, the lignin can be added to the size press as a solution or in a dispersed form. Solutions of lignins can be prepared by dispersing the lignin in water, adding sufficient alkali to achieve a final solution pH above about pH 9.5, and stirring until dissolved. Heating the solution while stirring can accelerate the process. Any base that can achieve the target pH may be used, such as sodium hydroxide, potassium hydroxide, ammonium hydroxide, trisodium phosphate and the like. Dispersions of lignin can be prepared according to the teachings of L. Liu, et al. in US 2015/0166836 A1, which is herein incorporated in its entirety. For the remainder of this document the term 'lignin' refers to either a solution or dispersion of the lignin, unless otherwise specified. It should be kept in mind that solutions of lignin may contain some amount of dispersed particles.

In yet other aspects of the above compositions, water-soluble zirconium salts can be mixed with the lignin. Examples of zirconium salts include ammonium zirconium carbonate (AZC), ammonium zirconium sulfate, ammonium zirconium lactate, ammonium zirconium glycolate, zirconium oxynitrate, zirconium nitrate, zirconium hydroxychloride, zirconium orthosulfate, zirconium acetate, potassium zirconium carbonate, and any other salts known to improve surface sizing efficiency as described by VE Pandian, et al. in U.S. Pat. No. 5,472,485.

In other aspects of the above compositions, aluminum salts that are water-soluble above pH 8 may be used such as, sodium aluminate and potassium aluminate. Additionally, other water-soluble salts may be employed. Addition levels of the salt range from about 1% to about 100% based on the amount of lignin, can be from about 1% to about 50% and may be from about 1% to about 25%. The lignin and salt can be added to the size press solution individually, or the lignin and salt can be combined before addition to the size press. Furthermore, the lignin and salt can be added at separate addition points on the paper machine.

In yet another aspect, the lignin solution or dispersion further comprises polymeric surface sizing agents. Known sizing agents include the salts of styrene maleic anhydride polymers, styrene acrylic acid polymers, ethylene acrylic or methacrylic acid polymers; cationic or anionic styrene acrylic latex. The synthetic polymers typically used as size press additives can be added separately, or combined with the lignin sizing formulation of the current invention. Lignins work in concert with these materials to provide improved resistance to aqueous penetrants.

The lignin solution or dispersion and optional salt, can be added to a standard size press solution. Most size press solutions are based on starch. The starch of the present methods may be derived from any of the known sources, for example corn, potato, rice, tapioca, and wheat and may be converted by means of enzyme, acid or persulfate treatments. The starch of the current methods is non-cationic and may be modified, including oxidized, ethylated, amphoteric, and hydrophobically modified as long as the starch is not predominantly nor nominally cationic.

Other water-soluble hydroxylated polymers that can be used in the above disclosed processes include carbohydrates such as non-cationic starch, alginates, carrageenan, guar gum, gum Arabic, gum ghatti, pectin and the like. Modified cellulosics such as carboxymethyl cellulose or hydroxyethylcellulose can be used. Synthetic water-soluble hydroxylated polymers such as fully and partially hydrolyzed polyvinyl alcohols can also be used. Any water-soluble hydroxylated polymer that can be applied to paper at a size press is suitable.

In some aspects of the above compositions, the addition levels of lignin or lignin mixtures with other sizing agents and salts will depend on the degree of sizing desired. Amounts can range from about 0.05% to about 1% by dry wt. fiber, can be from about 0.1% to about 0.9% and may be from about 0.1% to about 0.5% by dry wt. fiber. The addition level of lignin or lignin mixtures with other sizing agents and salts (on a dry basis) can be from about 0.01 $g/m^2$ to about 0.75 $g/m^2$ by dry wt. fiber, can be from about 0.05 $g/m^2$ to about 0.7 $g/m^2$ by dry wt. fiber and may be from about 0.1 $g/m^2$ to about 0.5 $g/m^2$ by dry wt. fiber. Efficacy will depend on a variety of factors including the quality of the lignin and characteristics of the basesheet, as would be obvious to those skilled in the art.

In yet another aspect of the above compositions, the addition level of lignin or lignin mixtures with other sizing agents and salts to recycled linerboard can be from about 0.05% to about 1% by dry wt. fiber, can be from about 0.1% to about 0.9% and may be from about 0.1% to about 0.5% by dry wt. fiber. The addition level of lignin or lignin mixtures with other sizing agents and salts (on a dry basis) can be from about 0.01 $g/m^2$ to about 0.75 $g/m^2$, can be from about 0.05 $g/m^2$ to about 0.7 $g/m^2$ and may be from about 0.1 $g/m^2$ to about 0.5 $g/m^2$.

In yet other aspects of the above compositions, the ratio of lignin to one or more secondary sizing agents can be from about 1:9 to about 9:1, can be from about 3:7 to about 8:2, and may be about 4:6 to about 8:2 lignin to secondary sizing agent and may be 4:6 to 8:2 lignin to secondary sizing agent.

In some aspects of the above processes, the water hydroxylated polymer can range from 0 to about 120 pounds per ton dry paper (lb/T) (0 to about 6%, based on dry paper), can be from about 40 lb/T to about 100 lb/T (from about 2% to about 5% based on dry paper) and may be from about 60 to about 100 lb/T (from about 3% to about 5% based on dry paper).

In some aspects of the above processes, the size press solution may optionally contain any of the normal size press additives, such as defoamers, biocides, non-cationic polymers, anionic dyes, sizing agents etc. Known sizing agents may also be included in the size press formulation. Known sizing agents include the salts of styrene maleic anhydride polymers, styrene acrylic acid polymers, ethylene acrylic or methacrylic acid polymers; cationic or anionic styrene acrylic latex; alkyl ketene dimers; alkenyl succinic anhydrides; fatty acid anhydrides; etc.

In other aspects of the above processes, the pH of the lignin sizing formulation at the size press is such that deposits are not formed, such as a neutral pH, or higher. The final pH of the size press solution can be from about pH 7 to about 11, can be a pH range of about 8 to about 10.5, and may be from about pH 9 to about 10.

In yet other aspects of the above processes, a decrease of the porosity (i.e., more closed) of the sheet was observed. Another benefit is a neutral or positive impact on slide angle vs. the negative impact of some of the reactive sizing agents (e.g., alkyl ketene dimer). Additionally, the dark color of the lignin can reduce the need for dyes in some applications.

In some aspects of the above processes, the lignin sizing formulation can be applied to the paper or paperboard using a size press or any other method that provides uniform controlled application of the formulation, such as dipping, soaking, spraying, rolling, painting or the like. Any of the size press configurations commonly used in the paper industry may be used, but the methods of applying the lignin sizing formulation to the paper or paperboard are not limited provided uniform controlled application is obtained. The formulation can be applied to paper formed on a paper machine and then only partially dried or it can be made on a paper machine to dried paper or the application can be done separate from the paper machine to paper that was formed, dried, and moved. One process is for paper to be formed with a paper machine, dried, and the lignin sizing formulation applied with a paper machine size press, and then for the paper to be dried again. The paper may be further modified by calendering.

In other aspects of the above processes, the lignin can be applied to the surface of the paper or paperboard prior to or subsequent to the hydroxylated polymer.

The paper or paperboard substrate which is treated in the current invention can be made from any pulp or combination of pulps, including recycled, groundwood, sulfite, bleached sulfite, kraft, bleached kraft, etc., obtained from any plant source. A pulp blend may contain some synthetic pulp. The paper or paperboard may or may not contain inorganic fillers such as calcium carbonate or clay and may or may not contain organic fillers. The lignin sizing formulation and optional salt are advantageously applied to paper or paperboard that contains calcium carbonate filler due to the alkaline nature of the size press solution. The paper substrate can also contain chemicals conventionally added to the stock in paper or board production, such as processing aids (e.g., retention aids, drainage aids, contaminant control additives, etc.) or other functional additives (e.g., wet or dry strength additives, dyes, etc.). The current lignin sizing formulation can also be used on paper grades such as recycled linerboard.

Definitions and Examples

For the purposes of this application, the term sizing refers to the ability of paper or board to resist penetration by aqueous liquids. Compounds that are designed to increase the hold-out of liquids are known as sizing agents. Sizing values are specific to the test used. Two common tests for measuring the resistance to aqueous penetrants are the Hercules Sizing Test and the Cobb test, described below. For a discussion on sizing see Principles of Wet End Chemistry by William E. Scott, Tappi Press 1996, Atlanta, ISBN 0-89852-286-2.

Descriptions of various sizing tests can be found in The Handbook of Pulping and Papermaking by Christopher J. Biermann Academic Press 1996, San Diego, ISBN 0-12-097362-6 and Properties of Paper: An Introduction ed. William E. Scott and James C. Abbott Tappi Press 1995, Atlanta, ISBN 0-89852-062-2.

Hercules Sizing Test

The Hercules Size Test (HST) is a standard test in the paper industry for measuring the degree of sizing (TAPPI Test Method T530 om-96). This method employs an aqueous dye solution as the penetrant to permit optical detection of the liquid front as it moves through the sheet. The apparatus determines the time required for the reflectance of the sheet surface not in contact with the penetrant to drop to a predetermined percentage of its original reflectance. All HST testing data reported measure the seconds to 80% reflectance using a solution containing 1% naphthalene green dye and 1% formic acid (No. 2 ink) or 1% naphthalene green dye at a neutral pH (neutral ink) unless otherwise noted. High HST values are better than low values. The amount of sizing desired depends upon the kind of paper being made and the system used to make it.

Cobb Test

The Cobb test is also a standard test in the paper industry for measuring the degree of sizing (TAPPI Test Method T441). This method measures the quantity of water absorbed by a sample of paper in a specified time. For the test results presented here, water at 23° C. was used as the penetrant and the test was run for the designated time.

Preparation of Samples

Paper samples for the examples below were prepared using either a laboratory puddle size press, a pilot paper machine or a Dixon coater as a puddle size press for higher speed applications. The general procedures are described here. Specific details are listed with each example. For the bench size press and Dixon coater experiments, base papers were prepared in advance on a commercial or pilot paper machine. The papers were made without any size press treatment, i.e., no starch, sizing agent, or other additives were applied to the surface of the formed paper. The pulp used to make the papers was prepared from recycled paper streams. The basis weight and sheet characteristics varied depending on source.

The size press formulations were prepared by cooking the starch for 45 minutes at 95° C., cooling and holding the cooked starch at the target treatment temperature, typically from about 60° C. to about 70° C. Other chemical additions and any pH adjustments were made and then the starch solution was used to treat the paper. For each base paper used, the amount of solution picked up through the rollers was determined and the starch concentration and additive levels set accordingly to give the target pick-up.

The benchtop puddle size press consisted of a horizontal set of ten inch (25.4 cm) pinched rollers, one rubber coated and one metal, through which the paper was fed. A puddle of the size press treatment was held by the rollers and dams on the top side of the rollers. The rollers were held together with 96.5 kilopascal (kPa) of air pressure. The paper passed through the puddle as it was pulled by the rollers, and through the rollers, to give a controlled and uniform level of treatment. The paper was allowed to sit for 30 seconds and then run through the size press a second time. After the second pass through the size press the paper was captured below the two rollers and immediately dried on a drum drier set at 99° C. The paper was dried to about a 3% to about 5% moisture level. After drying, each sample was conditioned by aging at room temperature.

The Dixon coater has a puddle size press, through which the base sheet can be fed at speeds up to 396 meter/minute. The puddle size press consists of a horizontal set of 22 cm rubber rolls, pressed together at 345 kilopascal. The sheet is dried to a moisture content of about 5% to about 7%, using an IR dryer at 160° C. The size press solution is made-up as described above.

Other samples used in the examples below were prepared using a pilot paper machine designed to simulate a commercial Fourdrinier paper machine. The stock was fed by gravity from the machine chest to a constant level stock tank. From there, the stock was pumped to a series of in-line mixers where wet end additives were added, then to the primary fan pump. The stock was diluted with white water at the fan pump to about 0.2% solids. Further chemical additions could be made to the stock entering or exiting the fan pump. The stock was pumped from the primary fan pump to a secondary fan pump, where chemical additions could be made to the entering stock, then to a flow spreader and to the slice, where it was deposited onto a 30 cm wide Fourdrinier wire. Immediately after its deposition on the wire, the sheet was vacuum-dewatered via three vacuum boxes; couch consistency was normally from about 14% to about 15% solids.

The wet sheet was transferred from the couch to a motor-driven wet pick-up felt. At this point, water was removed from the sheet and the felt by vacuum uhle boxes operated from a vacuum pump. The sheet was further dewatered in a single-felted press and left the press section at about 38% to about 40% solids.

Evaluations were made using a simulated recycled linerboard furnish, using a blend of recycled medium (80%) and old newsprint (20%) with a Canadian standard freeness of 350 cubic centimeter (cc) with 2.75% sodium lignosulfonate added to simulate anionic trash. The hardness and alkalinity were about 126 parts-per-million (ppm) and about 200 ppm, respectively. Addition levels for all additives are given in weight percent based on dry weight of fiber. Stock temperature was maintained at 55° C. The headbox pH was controlled at about pH 7.5 with caustic.

A 171 gram per square meter ($g/m^2$) (105 lb/3000 $ft^2$ ream) sheet was formed and dried on seven dryer cans to about a 6% moisture (dryer can surface temperatures at 90° C.). The sheet was then passed through a puddle size press where surface treatments were applied. The treated sheet was dried on five dryer cans to about 6% moisture and passed through a single nip of a S-nip, 6 roll calender stack. HST (Hercules Sizing Test, see Tappi Method T530 om-02) and Cobb (Tappi Method T441 om-04) sizing were measured on board naturally aged in a CT room (50% RH, 25° C.) for a minimum of 7 days.

Example 1. Lignin Solutions

A solution of lignin isolated using the LignoBoost™ process (BioChoice™ lignin available from Domtar) was prepared by dispersing 75.99 grams (g) lignin in 340.68 g water at ambient temperature, adding 25.06 g of 45% potassium hydroxide, heating to 75° C. and holding for 30 minutes at 75° C. The solution was then cooled to room temperature. The final solution had a pH of 11.58 with total solids of 15.6%. This solution was added to the starch solution (National 3040 oxidized starch, 8.2% solids at 60° C.) being used to treat the surface of a recycled linerboard basesheet (50#/T starch pickup, 2.5 wt % based on dry board) from Taiwan using a Dixon coater as a pilot size press, with no other additives. The final size press solution had a pH of about 10. The results of sizing tests conducted on the surface treated board are listed in Table 1 and show that low levels of LignoBoost™ lignin provide resistance to aqueous penetrants.

Example 2. Lignin Dispersions

A dispersion of lignin isolated using the LignoBoost™ process (BioChoice™ lignin available from Domtar) was prepared by mixing 60.23 parts BioChoice™ (Domtar Inc., West, Montreal, QC) kraft lignin of about 27% moisture with 2.98 parts potassium carbonate in 99.88 parts water. The mixture was heated to reflux, while stirring, within 15 minutes until a homogeneous liquid dispersion was obtained. While heating to reflux, it was observed that the mixture turned from a grayish suspension to viscous black liquid at around 80° C., indicating the initial formation of a lignin nanoparticle dispersion. After cooling to about 70° C., the dispersion was diluted with cold water (see US 2015/0166836 A1, L. Liu, et. al., paragraph 106, which is incorporated by reference).

The final dispersion had a pH of 8.3 with total solids of 21.0%, a Brookfield viscosity of 16 centipoise (spindle 1, 60 rpm) and a mean particle size of 186 micron (Horiba LA-300). This dispersion was evaluated in the same manner as the solution in Example 1. The sizing results are included in Table 1 and demonstrate that dispersions of this lignin sizing formulation similarly provide resistance to aqueous penetrants.

TABLE 1

| | | HST Number of Reps 3 #2 INK/ 80% REFL TREATED SIDE 24 Aging Temp | | COBB TEST Number of Reps 2 2 MIN SK/WTR TREATED SIDE 24 Aging Temp | |
|---|---|---|---|---|---|
| Additive | % | Seconds Mean | Std Dev | g/sq m Mean | Std Dev |
| None | | 3 | | 211 | |
| Example 1 | 0.1 | 26 | 4.0 | 176 | 3.5 |

TABLE 1-continued

| | | HST Number of Reps 3 #2 INK/ 80% REFL TREATED SIDE 24 Aging Temp | | COBB TEST Number of Reps 2 2 MIN SK/WTR TREATED SIDE 24 Aging Temp | |
|---|---|---|---|---|---|
| Additive | % | Seconds Mean | Std Dev | g/sq m Mean | Std Dev |
| Example 1 | 0.2 | 211 | 34.6 | 41 | 2.1 |
| Example 1 | 0.4 | 729 | 70.4 | 28 | 0.0 |
| Example 1 | 0.6 | 772 | 36.8 | 30 | 0.7 |
| Example 2 | 0.1 | 21 | 4.6 | 185 | 3.5 |
| Example 2 | 0.2 | 62 | 10.7 | 139 | 5.7 |
| Example 2 | 0.4 | 292 | 29.3 | 50 | 5.7 |
| Example 2 | 0.6 | 564 | 49.0 | 35 | 0.7 |

Example 3. Kraft Lignins

Solutions of lignins from other sources were prepared using the procedure outlined in Example 1. Lignin sources included the LignoBoost™ process (BioChoice™ from Domtar), the LignoForce™ process (see US 2011/029734 A1), Indulin AT, a kraft lignin from MeadWestvaco, and a sulfite lignin from LignoTech. The lignin solutions were added to a starch solution (Grain Processing D28F oxidized starch, 12% for a starch pick up of about 73 lb/T) and applied using the Dixon coater as a pilot size press to a commercial recycled linerboard basesheet from Taiwan. There were no other size press additives. The results of the sizing tests conducted on the surface treated board, are listed in Table 2. The kraft lignins provide resistance to aqueous penetrants, whereas the sulfite lignin was not effective in decreasing the resistance of the board to the aqueous penetrant.

TABLE 2

| | | COBB TEST Number of Reps 2 2 MI SK/WTR FELT SIDE 24 Aging Temp | | HST Number of Reps 3 Neutral Ink/ 80% R FELT SIDE 24 Aging Temp | | HST Number of Reps 3 #2 Ink/80% R FELT SIDE 24 Aging Temp | |
|---|---|---|---|---|---|---|---|
| PRODUCT 1 | DOSAGE (%) | g/sq m Mean | Std Dev | Seconds Mean | Std Dev | Seconds Mean | Std Dev |
| Blank | 0.0 | 177 | 0.7 | 29 | 1.0 | 52 | 17.8 |
| LignoBoost ™ | 0.1 | 153 | 2.8 | 55 | 1.5 | 80 | 5.2 |
| LignoBoost | 0.2 | 120 | 1.4 | 95 | 2.1 | 200 | 18.1 |
| LignoBoost | 0.4 | 68 | 1.4 | 173 | 5.9 | 684 | 16.3 |
| LignoForce ™ | 0.1 | 149 | 0.8 | 57 | 1.0 | 87 | 8.6 |
| LignoForce | 0.2 | 124 | 0.7 | 105 | 7.2 | 251 | 34.4 |
| LignoForce | 0.4 | 53 | 4.9 | 202 | 8.5 | 918 | 48.9 |
| Sulfite lignin | 0.1 | 210 | 2.1 | 21 | 1.2 | 41 | 6.7 |
| Sulfite lignin | 0.2 | 214 | 3.5 | 23 | 1.2 | 48 | 5.5 |
| Sulfite lignin | 0.4 | 210 | 4.2 | 24 | 1.8 | 54 | 7.8 |
| Kraft lignin | 0.1 | 200 | 6.4 | 48 | 1.2 | 76 | 5.5 |
| Kraft lignin | 0.2 | 160 | 2.1 | 85 | 2.5 | 295 | 38.5 |
| Kraft lignin | 0.4 | 89 | 4.9 | 154 | 2.6 | 867 | 80.8 |

Example 4. Pretreatment of the Substrate with Alum has No Beneficial Impact on Sizing Recycled linerboard basesheet was produced on the pilot papermachine with and without alum added at the wet end. The basesheets were treated with a solution of lignin isolated using the LignoBoost™ process (BioChoice™ lignin available from Domtar) prepared according to Example 1. The lignin solution was added to the starch solution (Grain Processing D28F oxidized starch, 12% solution) with no other additives, giving a size press pH of about 10. This was applied on the pilot papermachine. Starch pick up was 80 lb/T (4%) and the LignoBoost™ concentration was varied to give the pickups indicated in Table 3 along with the results of the sizing test conducted on the surface treated board.

TABLE 3

| | | | | HST Number of Reps 5 #2 Ink/ 80% Refl. | | HST Number of Reps 5 Neutral Ink/ 80% Refl. | |
|---|---|---|---|---|---|---|---|
| Wet end | Dosage % | Size Press | Dosage % | Seconds Mean | Std Dev | Seconds Mean | Std Dev |
| BLANK | 0.0 | Blank | 0.0 | 5 | 0.45 | 6 | 0.00 |
| BLANK | 0.0 | LignoBoost ™ | 0.1 | 16 | 0.71 | 19 | 1.30 |
| BLANK | 0.0 | LignoBoost | 0.2 | 54 | 5.03 | 32 | 3.00 |
| BLANK | 0.0 | LignoBoost | 0.4 | 241 | 44.97 | 49 | 4.97 |
| Alum | 0.5 | LignoBoost | 0.1 | 19 | 0.71 | 20 | 0.55 |
| Alum | 0.5 | LignoBoost | 0.2 | 50 | 3.96 | 31 | 1.52 |
| Alum | 0.5 | LignoBoost | 0.4 | 194 | 29.10 | 48 | 1.30 |

Example 5. Pretreatment of the Substrate with Cationic Polymer has No Beneficial Impact on Sizing A solution of lignin isolated using the LignoBoost™ process (BioChoice™ lignin available from Domtar) was prepared according to Example 1. The lignin solution was added to the starch solution (Grain Processing D28F oxidized starch, 12%) used to treat the surface of a recycled linerboard basesheet (70 lb/T pick up, 3.5%) using a pilot size press, with no other additives, giving a size press pH of about 10. The recycled linerboard basesheet was prepared on the pilot papermachine with either no wet end additives, or with a cationic polymer, Hercobond 1000 (glyoxylated polyacrylamide available from Solenis LLC), added at a level of 0.15 wt % based on dry pulp. The results of the sizing test conducted on the surface treated board are listed in Table 4. The addition of the cationic polymer to the basesheet had no beneficial impact on sizing development.

TABLE 4

| | | HST Number of Reps 5 | |
|---|---|---|---|
| Size Press | DOSAGE (%) | Seconds Mean | Std Dev |
| No Wet End Additives | | | |
| Blank | 0.000 | 7 | 0.0 |
| LignoBoost ™ | 0.100 | 23 | 1.0 |
| LignoBoost | 0.200 | 89 | 10.7 |
| LignoBoost | 0.400 | 326 | 29.3 |

TABLE 4-continued

| | | HST Number of Reps 5 | |
|---|---|---|---|
| Size Press | DOSAGE (%) | Seconds Mean | Std Dev |
| 0.15% Hercobond 1000 | | | |
| Blank | 0.000 | 5 | 0.4 |
| LignoBoost | 0.100 | 23 | 0.9 |
| LignoBoost | 0.200 | 83 | 6.3 |
| LignoBoost | 0.400 | 276 | 58.2 |

Example 6. Ammonium Zirconium Carbonate Boosts Sizing Performance

Recycle liner board (RLB) paper produced in an American mill and made with no surface treatment was used for the experiment. The paper was treated with a laboratory puddle size press with oxidized starch that was cooked at 95° C. for 45 minutes. The starch concentration was 13.5%. The paper was fed through the size press and held for 60 seconds, flipped over and fed again through the size press to obtain a uniform pick-up of 0.45 parts on a dry basis per 100 parts of paper (dry basis). To the starch was added a solution of BioChoice™ lignin prepared as described in Example 1, using sodium hydroxide for pH adjustment. The level of lignin was such that when used on its own with the starch, without additives, there was 0.075 parts-per-hundred (pph) lignin on a dry basis to the weight of the dry paper. Various levels of ammonium zirconium carbonate (AZC) were added in place of some of the lignin to obtain final levels, on a dry basis, of 0.065 pph lignin plus 0.01 pph AZC and in another experiment 0.05 pph lignin plus 0.025 pph AZC. The AZC was added as a solution in water. Table 5, expresses the levels in pounds of dry additive per ton (2000 lb) of paper. All of the starch/sizing solutions used to treat the paper were used without adjusting the pH. The pH of the lignin solution was 10.5 and the solids were 10%. AZC was also run without the lignin.

The lignin led to better paper sizing (lower Cobb values) than the paper alone. Addition of AZC further improved the sizing (even lower Cobb values) whereas addition of AZC to the lignin led to a synergistic, and totally unexpected boost in sizing performance.

TABLE 5

| Lignin solution, lb/T | AZC, lb/T | Cobb, g/sq m Water 3 minute |
|---|---|---|
| 1.5 | 0 | 123 |
| 1.3 | 0.2 | 103 |

TABLE 5-continued

| Lignin solution, lb/T | AZC, lb/T | Cobb, g/sq m Water 3 minute |
|---|---|---|
| 1 | 0.5 | 82 |
| 0 | 0.5 | 143 |
| 0 | 1 | 146 |

Example 7. Bases Used in Preparation can Influence Performance

Lignin solutions were prepared from BioChoice™ lignin from Domtar using the procedure outlined in Example 1, except a different base was used in this procedure. These solutions were evaluated as described in Example 6 at 0.075%, using an oxidized starch at 80 lb/T (4%). The results are summarized in Table 6.

TABLE 6

| Base | HST, sec Neutral ink 80% R | Cobb, g/sq m Water 3 minute |
|---|---|---|
| Sodium Hydroxide | 142 | 124 |
| Potassium Hydroxide | 145 | 124 |
| Ammonium Hydroxide | 96 | 130 |
| Trisodium Phosphase | 55 | 140 |

Example 8. Lignin Alone, or with Sodium Aluminate, Decreases Sheet Porosity

A solution of lignin isolated using the LignoBoost™ process (BioChoice™ lignin available from Domtar) was prepared according to Example 1. The lignin solution was added to the starch solution (Grain Processing D28F oxidized starch, 12%) used to treat the surface of a recycled linerboard basesheet (70 lb/T pick up, 3.5%) using a pilot size press, with no other additives, giving a size press pH of about 10. The recycled linerboard basesheet was prepared on the pilot papermachine with no wet end additives. The results of a porosity test, Gurley porosity (Tappi Method T460 om-96) on the surface treated board are listed in Table 7. HST data are also included in Table 7, as an example of the sizing improvement provided by the addition of sodium aluminate.

TABLE 7

| Additive 1 | DOSAGE (%) | Additive 2 | DOSAGE (#/t) | GURLEY POROSITY Number of Reps 5 Sec/100 ex Mean | Std Dev | HST Number of Reps 5 pH 7 Ink/80% R Seconds Mean | Std Dev |
|---|---|---|---|---|---|---|---|
| No Wet End Additives | | | | | | | |
| Blank | 0.000 | none | 0.000 | 34.9 | 2.48 | 10.0 | 3.1 |
| LignoBoost ™ | 0.100 | none | 0.000 | 38.9 | 3.15 | 18.8 | 0.8 |
| LignoBoost | 0.200 | none | 0.000 | 42.9 | 2.46 | 37.4 | 1.5 |
| LignoBoost | 0.400 | none | 0.000 | 55.0 | 3.03 | 60.8 | 8.6 |
| Blank | 0.000 | none | 0.000 | 35.8 | 1.66 | 6.4 | 0.5 |
| BC soln | 2.000 | Sodium Aluminate | 1.000 | 42.8 | 4.57 | 79.0 | 3.2 |
| BC soln | 4.000 | Sodium Aluminate | 2.000 | 67.0 | 5.08 | 185.2 | 18.0 |
| BC soln | 8.000 | Sodium Aluminate | 4.000 | 130.7 | 12.21 | 367.6 | 53.6 |

Example 9

The type of Lignin solution and procedure of example 6 was utilized again, using the same starch and conditions. A dosage of 0.2% lignin added with the starch at the size press was compared with the addition of various other sizing agents and in combination with the other sizing agents. In the combinations 0.15% lignin was added with 0.05% of the other sizing agent. The sizing agents were added separately to the starch solution of the size press. There was no attempt to control the pH of the size press starch or the size press solution after the addition of the materials.

The sizing agents test and mixes with the lignin were as follows:

a. A starch stabilized anionic latex utilized typically for fine paper sizing comprising a copolymer of styrene and n-butyl acrylate and a glass transition temperature around 20° C., available from Solenis as Chromaset™ 800.

b. A cationic polymer latex comprising a copolymer of styrene and butyl acrylates with a glass transition temperature around 50° C. which is typically used to surface size recycle liner board.

c. A solution of an 80:20 copolymer of ethylene and acrylic acid dispersed in a solution of ammonium hydroxide.

For each anionic sizing agent combined with lignin the combination of the two materials at a total of 0.2% addition gave more sizing than 0.2% addition of either material alone, thus showing unexpected synergistic sizing results. The performance of the cationic latex was reduced under these conditions by the combination with the lignin. The results are summarized in TABLE 8.

TABLE 8

| Additive 1 | Level of Additive 1 (%) | Additive 2 | Level of Additive 2 (%) | pH of size press | 3 min. Cobb ($g/m^2$) | Neutral HST (sec) |
|---|---|---|---|---|---|---|
| Lignin | 0.2 | none | 0 | 9.3 | 63 | 282 |
| Sizing A | 0.2 | none | 0 | 5.75 | 56 | 275 |
| Sizing A | 0.05 | Lignin | 0.15 | 9.03 | 43 | 431 |

TABLE 8-continued

| Additive 1 | Level of Additive 1 (%) | Additive 2 | Level of Additive 2 (%) | pH of size press | 3 min. Cobb ($g/m^2$) | Neutral HST (sec) |
|---|---|---|---|---|---|---|
| Sizing B | 0.2 | none | 0 | 4.23 | 38 | 603 |
| Sizing B | 0.05 | Lignin | 0.15 | 7.25 | 61 | 191 |
| Sizing C | 0.2 | none | 0 | 8.98 | 120 | 50 |
| Sizing C | 0.05 | Lignin | 0.15 | 9.16 | 58 | 217 |

For the above test the Cobb test utilized a 3 minute soaking of the paper before pick-up of the water was measure and for the Hercules Sizing Test a neutral ink was used, i.e. green ink diluted with water in place of formic acid.

Example 10

The lignin and starch solutions and procedures used in Example 4 were used in this Example. As in example 4, a pilot paper machine was used to prepare paper and the formulation applied to the surface of the paper at a size press. No alum was used in the wet-end of the paper machine.

At the size press a solution of GPC D28F starch was used at a concentration to give 3.5% starch addition to the paper on a dry basis. The sizing agents were added to the starch to give the levels listed below and the paper was tested as in other examples. In addition to the normal testing the coefficient (static and kinetic) of the paper was determined with a weighted sled sliding on a piece of paper. The sled was covered on the bottom with the paper and the wire side of the paper was slid along the wire side of base paper. The paper base was moved under the sled and the force required to start the movement and maintain it at a constant rate was measured to give the coefficients of friction, see TAPPI Test Method T549.

A control sheet with no sizing was tested, along with a sheet with a commercial cationic RLB sizing agent added at a level of 0.2%. Paper with lignin as the sizing agent was tested with 0.2 and 0.4% lignin added. A paper was tested that had a treatment of 0.175% lignin and 0.025% AZC, and a paper was tested that had a treatment of 0.15% lignin and 0.05% AZC, all with the same level of size press starch added. The results of sizing and COF values are listed in the following table.

TABLE 9

| Additive 1 | Level of Additive 1 (%) | Additive 2 | Level of Additive 2 (%) | 2 min. Cobb ($g/m^2$) | Static COF | Kinetic COF |
|---|---|---|---|---|---|---|
| None | | none | | 252 | 0.45 | 0.40 |
| Cat. Latex | 0.2 | none | | 70 | 0.42 | 0.32 |
| Lignin | 0.2 | none | | 56 | 0.52 | 0.41 |
| Lignin | 0.4 | none | | 46 | 0.54 | 0.41 |
| Lignin | 0.175 | AZC | 0.025 | 39 | 0.51 | 0.39 |
| Lignin | 0.15 | AZC | 0.05 | 39 | 0.57 | 0.39 |

It was quite surprising to see that lignin, although giving a more effective amount of sizing compared to the sheet with no additive or compared to the sheet with the cationic latex, showed an increase in both static and kinetic COF. The cationic latex gave the expected result of a decrease of COF with improved sizing. Addition of more lignin further increased the static COF. In addition, adding AZC with the lignin, improved significantly the level of sizing yet still gave a significantly higher static COF than the sample with no surface sizing additive and much better than the sample with the cationic latex sizing agent. The kinetic COF was lower with the addition of AZC than with the lignin alone or than the control sheet, although all are within statistical variation. Coefficient of friction is very important for linerboard because when boxes are stacked on each other one does not want the top box or boxes to easily slide off the lower ones.

We claim:

1. A composition for treating the surface of a paper product comprising:

a water-soluble, hydroxylated polymer provided the hydroxylated polymer is not a cationic starch; and an alkaline solution or dispersion of isolated lignin that is only soluble under alkaline conditions; wherein the composition has a pH of from about 7 to about 11; and wherein the composition is applied to the surface of the paper product providing the paper product resistance to aqueous penetrants.

2. The composition of claim 1, wherein the water-soluble, hydroxylated polymer is selected from the group consisting of carbohydrates, modified cellulosic, and synthetic water-soluble hydroxylated polymers.

3. The composition of claim 1, wherein the isolated lignin is a purified isolated lignin.

4. The composition of claim 1, further comprising one or more sizing agents.

5. A composition for treating the surface of a paper product comprising:

a. a water-soluble zirconium or aluminum salt selected from the group consisting of ammonium zirconium carbonate (AZC), ammonium zirconium sulfate, ammonium zirconium lactate, ammonium zirconium glycolate, zirconium oxynitrate, zirconium nitrate, zirconium hydroxychloride, zirconium orthosulfate, zirconium acetate, potassium zirconium carbonate, sodium aluminate, potassium aluminate and combinations thereof, and b. an alkaline solution or dispersion of non-sulfonated lignin or lignin that is only soluble under alkaline conditions; wherein the composition has a pH of from about 7 to about 11; and wherein the composition is applied to the surface of the paper product thereby providing resistance to aqueous penetrants.

6. The composition of claim 5, further comprising one or more sizing agents.

7. The composition of claim 5, wherein the water-soluble zirconium or aluminum salt is added in an amount of from about 1% to about 100% based on the amount of lignin.

8. A composition for treating the surface of a paper product comprising:

a. one or more of a sizing agent selected from the group consisting of salts of styrene maleic anhydride polymers, styrene acrylic acid polymers, ethylene acrylic acid polymers, methacrylic acid polymers, and anionic styrene acrylic latex; and b. an alkaline solution or dispersion of isolated lignin that is only soluble under alkaline conditions; wherein the composition provides resistance to aqueous penetrants; wherein the composition has a pH of from about 7 to about 11; and the composition is applied to the surface of a paper product.

9. A composition for treating the surface of a paper product comprising:

a water-soluble, hydroxylated polymer provided the hydroxylated polymer is not a cationic starch; and an alkaline solution or dispersion of non-sulfonated lignin or lignin that is only soluble under alkaline conditions; and a water-soluble zirconium or aluminum salt;

wherein the composition is applied to the surface of the paper product providing the paper product resistance to aqueous penetrants.

10. The composition according to claim 9, wherein the zirconium or aluminum water-soluble salt is selected from the group consisting of ammonium zirconium carbonate (AZC), ammonium zirconium sulfate, ammonium zirconium lactate, ammonium zirconium glycolate, zirconium oxynitrate, zirconium nitrate, zirconium hydroxychloride, zirconium orthosulfate, zirconium acetate, potassium zirconium carbonate, sodium aluminate, potassium aluminate and combinations thereof.

* * * * *